United States Patent [19]

Fleck et al.

[11] Patent Number: 4,633,601

[45] Date of Patent: Jan. 6, 1987

[54] EXCAVATING SHOVEL

[75] Inventors: Robert S. Fleck, Beaverton; John S. Kreitzberg, Portland, both of Oreg.

[73] Assignee: Esco Corporation, Portland, Oreg.

[21] Appl. No.: 654,371

[22] Filed: Sep. 25, 1984

[51] Int. Cl.[4] ..... E02F 3/00

[52] U.S. Cl. ..... 37/118 R; 403/107; 414/722; 414/726

[58] Field of Search ..... 37/117.5, 118 R, 118 A, 37/DIG. 3, DIG. 12; 414/722, 740, 726; 403/107, 225

[56] References Cited

U.S. PATENT DOCUMENTS

| | | | |
|---|---|---|---|
| 3,854,608 | 12/1974 | Arnold | 37/117.5 X |
| 3,915,501 | 10/1975 | Cobb et al. | 37/117.5 X |
| 4,283,866 | 8/1981 | Ogawa | 37/117.5 |
| 4,317,393 | 3/1982 | Graffam | 403/107 X |
| 4,322,062 | 3/1982 | Aleck | 403/225 X |
| 4,375,345 | 3/1983 | Hanson | 37/117.5 X |
| 4,566,844 | 1/1986 | Campih | 414/726 |

*Primary Examiner*—Edgar S. Burr
*Assistant Examiner*—Moshe I. Cohen
*Attorney, Agent, or Firm*—Tilton, Fallon, Lungmus & Chestnut

[57] ABSTRACT

An excavating shovel having pivotally interconnected back and front sections and wherein the front section has a torque tube supported by bushing means on the back section and wherein the torque tube is equipped with radially extending moment arm means for pivotal actuation of the front section toward and away from the back section.

8 Claims, 8 Drawing Figures

EXCAVATING SHOVEL

BACKGROUND AND SUMMARY OF INVENTION

This invention relates to an excavating shovel and, more particularly, a shovel having a bottom dump bucket.

Bottom dump buckets have been used for many years in excavating—the smaller sizes for back hoes as can be seen in U.S. Pat. No. 3,767,070. The larger size buckets, such as those used on shovels, have used dual pinned hinge arrangements to open and close the front and these have presented difficulties both in construction and operation. Where smaller buckets, as in the '070 patent, are to be enlarged, considerable design change is required.

According to the instant invention, the shovel bucket includes a back section and a front section pivotally related and connected through a torque tube which also serves as the hinge. By virtue of this arrangement, we are able to provide a spatial arrangement which develops efficient digging by virtue of having the moving actuators spaced away from the digging action and while substantially protecting the actuators. Other advantages and objects of the invention may be seen in the details of the ensuing specification.

The invention is described in conjunction with the accompanying drawing in which FIG. 1 is a fragmentary side elevational view of a shovel bucket incorporating the instant invention;

DETAILED DESCRIPTION

Figure 1:
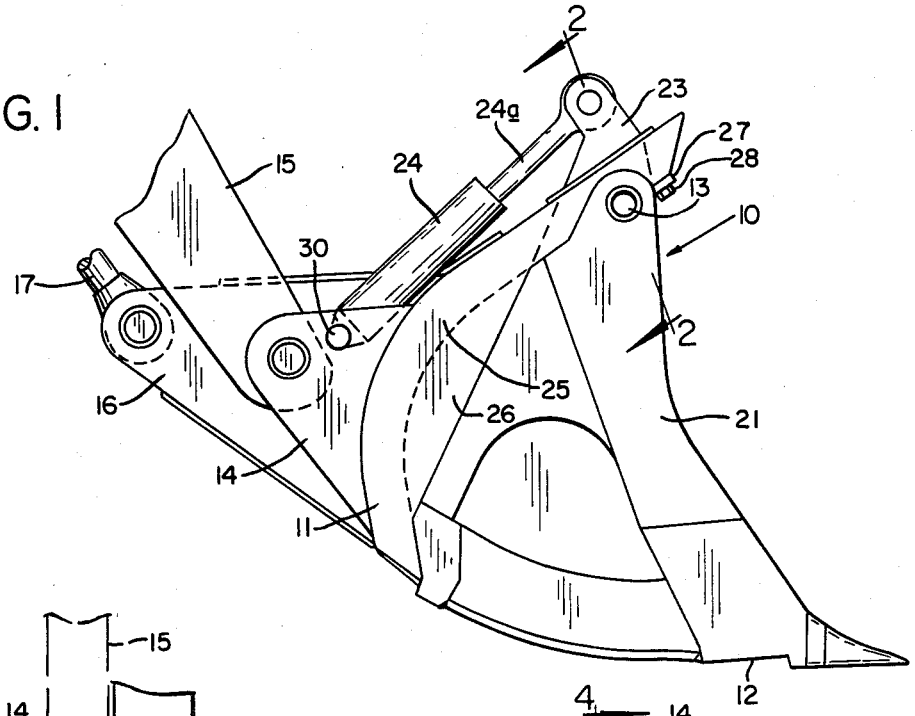
Figure 3:
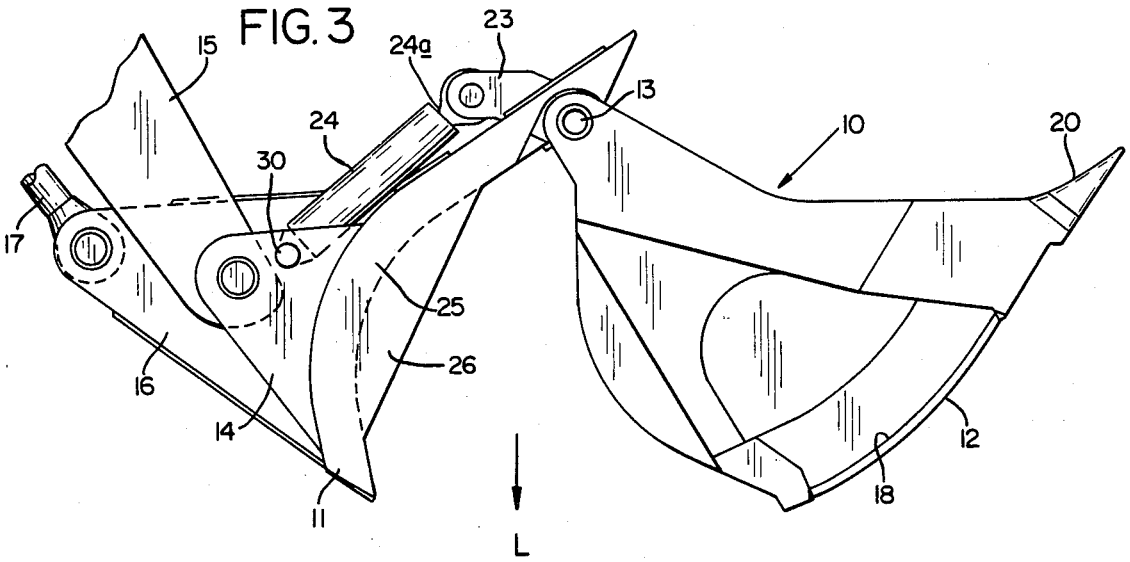
FIG. 3 is a view similar to FIG. 1 but with the bucket front and back section in open position.

In the illustration given, and with reference to the first drawing sheet, particularly FIGS. 1 and 3, the numeral 10 designates generally a shovel bucket which incorporates teachings of this invention. The bucket includes a back section 11 and a front section 12 pivotally interconnected as at 13.

Figure 2:
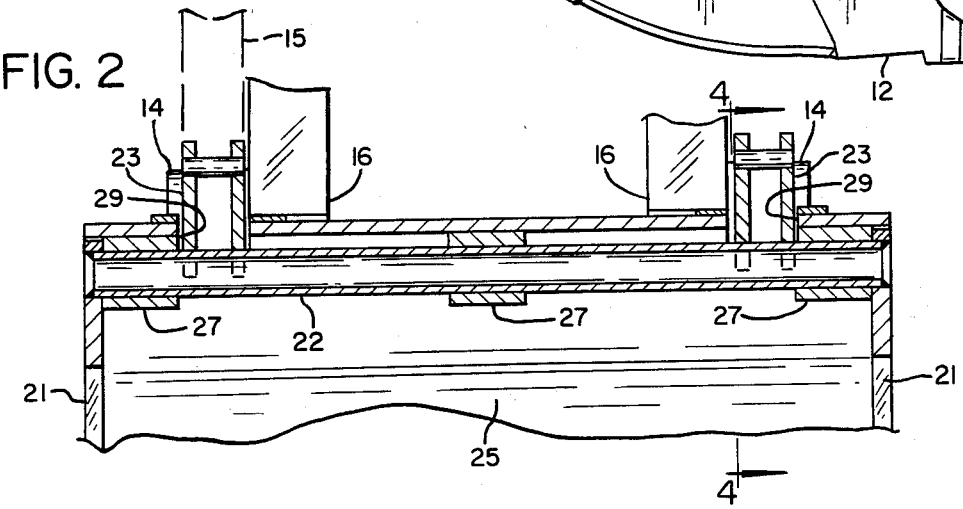
FIG. 2 is a fragmentary sectional view taken along the sight line 2—2 of FIG. 1.

The back section 11 is equipped with a pair of brackets as at 14—see also the central upper part of FIG. 2 to which is pivotally connected the usual hydraulic excavator or face shovel stick 15. Additional brackets are provided as at 16 for the connection of the cylinder and piston rod unit 17 which is interconnected also with the hydraulic excavator stick 15. In other words, the hydraulic excavator stick 15 raises and lowers the shovel bucket 10 in conventional fashion while the cylinder and piston rod unit 17 pivots the bucket 10 relative to the hydraulic excavator stick, again in conventional fashion. In contrast, the instant invention has to do with the structure, cooperation and actuation of the two sections 11 and 12 which make up the bucket 10.

Front Section

Figure 5:
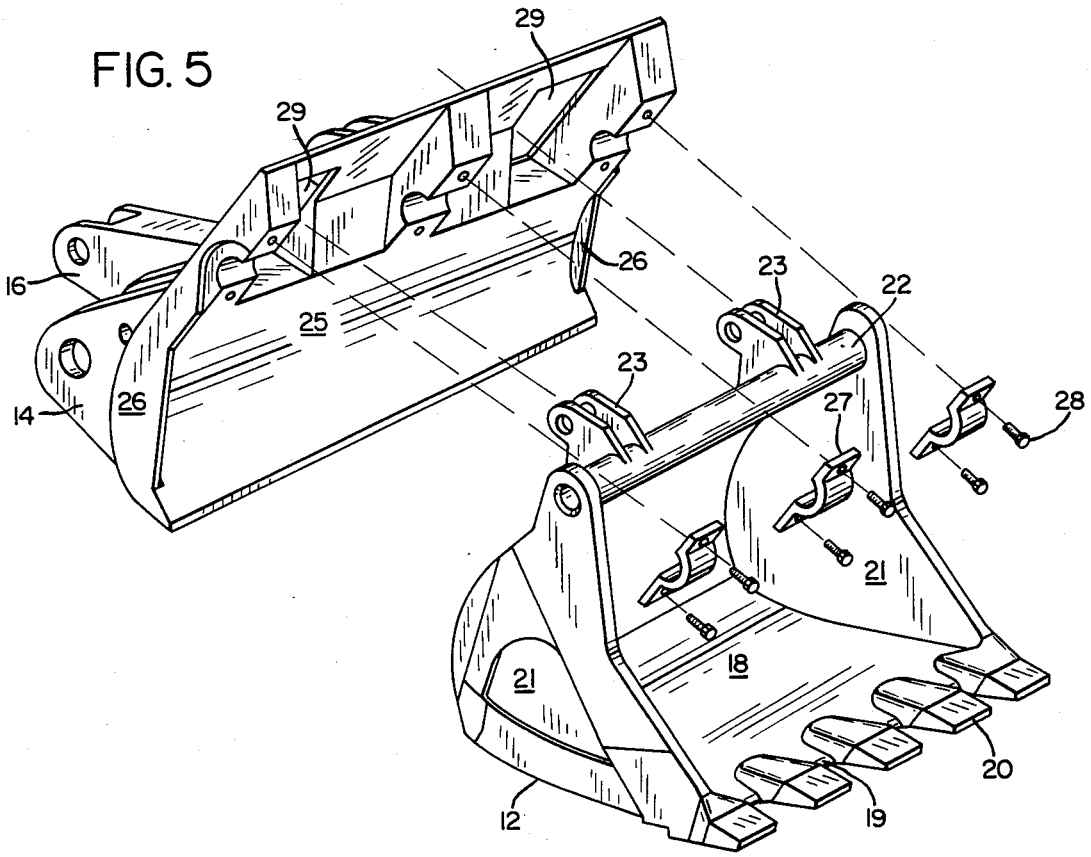
FIG. 5 is an exploded perspective view of the inventive shovel bucket.

The front section 12 of the bucket can be seen in perspective view in FIG. 5 and is seen to include a bottom wall 18 which is curved outwardly—compare the lower right hand portion of FIG. 3. The bottom wall terminates in an earth engaging edge 19 to which is affixed a number of excavating teeth as at 20.

Upstanding from each side of the bottom wall 18 are side walls 21 and which have rigidly connected therebetween at their upper portions a torque tube hinge 22. The torque tube 22 is equipped, in the illustration given, with a pair of moment arm means 23 which are spaced axially on the torque tube 22 and which extend radially away from the torque tube—rearwardly so as to be pivotally connected to cylinder and piston rod units as at 24 (see FIG. 1) for pivoting the front section 12 relative to the back section 11. By varying the length of the arms 23, force and speed of this relative pivoting can be altered to match the piston rod units 24 and the hydraulic system operational characteristics.

Back Section

The back section 11 can also be appreciated from a consideration of FIG. 5 and is seen to include essentially a back wall 25 which is outwardly curved—see the central portion of FIG. 3. The rear wall 25 is flanked by relatively narrow side walls as at 26 which cooperate with the side walls 21 of the front section 12 in closing the shovel for excavation. The curvature developed by the bottom wall 18 and back or rear wall 25 produces a rollover or boiling action of the earth being excavating in contrast to the prior art wedge design which creates a constant packing effect in the back bottom corner of the bucket.

In the illustration given, we provide bushing means in the form of three supports 27 which are spaced axially along the torque tube 22 and which rotatably attach the torque tube—and hence the front section 12—to the rear section 11. This is done, in the illustration given, through suitable bolts 28.

Figure 4:
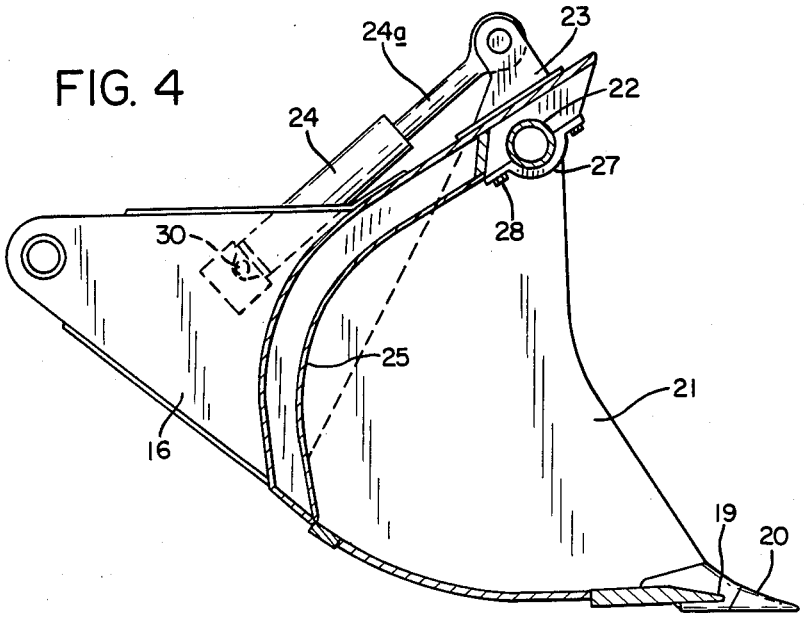
FIG. 4 is a sectional view of the bucket such as would be seen along the sight line 4—4 of FIG. 2.

The back section adjacent its upper part is equipped with window means in the form of openings 29 through which the arm means 23 project. This could be appreciated from a consideration of FIG. 4 where the arm means are pivotally connected to the piston rod 24*a* of the cylinder and piston rod unit 24—the power end of the unit 24 being pivotally connected as at 30 to its associated bracket 14.

Operation

In the operation of the inventive bucket shovel, the bucket is maneuvered in conventional fashion through the cooperation of the dipper stick 15 and dipper stick cylinder and piston rod unit 17 so as to achieve a load which then can be elevated and swung to a dump position—as over a truck or the like. At that time, the cylinder and piston rod units 24 are actuated, viz., the rod 24*a* is retracted from the FIG. 1 position to that of FIG. 3 whereupon the front section 12 is pivoted relative to the back section 11 so as to dump the load as at L in FIG. 3.

By the arrangement described herein, the torque tube 22 absorbs shocks during opening and closing by the ability of the torque tube to act as a twisting spring absorbing shock energy. Where the beam spanning the front section is offset from the pivot axis as in the '070 patent, the beam must be relatively stiff to absorb the loads from the actuating cylinder and therefore has little spring action, resulting in higher shock loads to the front and back sections. Also, the torque tube 22 in contrast to the larger, commercially available shovel buckets eliminates the need for pins and the attachments to the front and back, lowering maintenance costs. More particularly, all working stress loads, either from loading or dumping are transmitted through the torque tube and torque arm of the instant invention, thereby distributing the load through the side plates 21, reducing structural overload due to assymetric hinge loading. The conventionally dual pin hinge arrangement requires hinges to be mounted on the upper outside corners of the back section with the hinge arms protruding through holes cut into the back assembly in the same location as the hinge structure for attachment of cylinders. This type of hinge makes all stress loads pass through the hinge window which is weakly supported structurally. The inventive design allows the windows 29 to be separated from the torque tube supports 27, thereby allowing the location of the windows 29, the torque tube arms 23 and the piston rod units 24 to be customized to mate with any hydraulic excavator structure.

Additionally, the spatial arrangement results in having the cylinder and piston rod units 24 essentially protected by virtue of being completely outside of the loading zone of the bucket.

Figure 6:
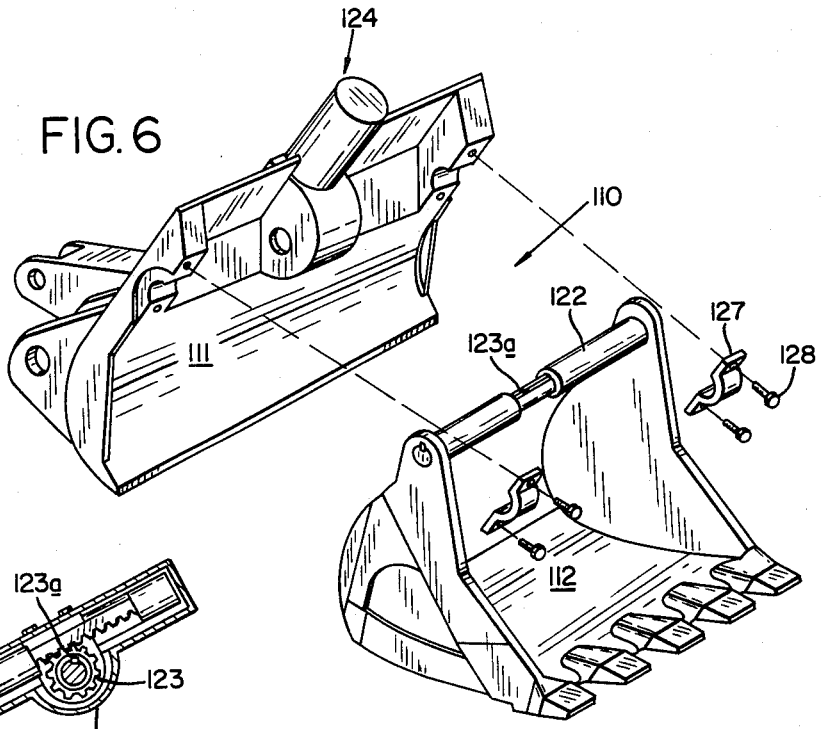
FIG. 6 is an exploded perspective view of a shovel bucket employing a rotary actuator according to the invention.
Figure 7:
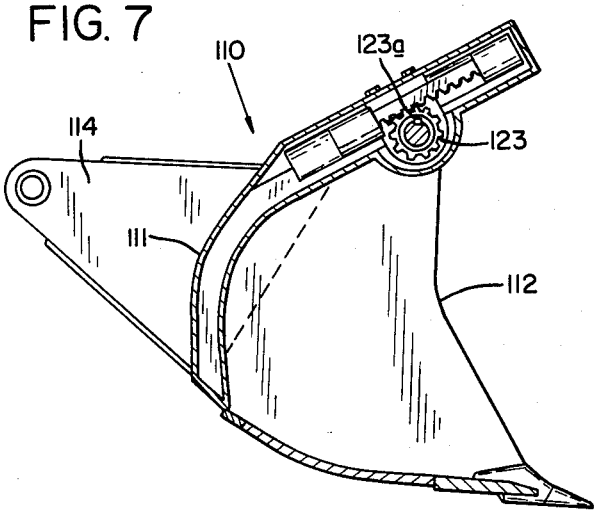
FIG. 7 is a longitudinal sectional view through the bucket of FIG. 6.

Reference is now made to a modified form of the invention which is seen in FIGS. 6 and 7 and relates to a shovel bucket of the kind just described but wherein the actuator means are provided in the form of the rotary action gear. For convenience and clarity, like parts in this second embodiment are referred to by the same numerals as those in the first embodiment, but with the addition of the numeral 100. For example, the bucket 110 includes a back section 111 and a front section 112. Brackets 114 are also provided as before.

Referring particularly to FIG. 6, a torque tube 122 is provided on the front section 112 and supported against the back section 111 by means of supports 127 secured by bolts 128. The difference between this embodiment and the one previously described lies in the different type of actuator means. Instead of the cylinder and piston rod units 24, we provide a rotary actuator generally designated 124. Also, instead of having a radially projecting arm means 23, we provide a key-secured gear 123 (see FIG. 7). It will be appreciated from consideration of FIG. 6 that the key 123*a* projects radially to serve as part of the moment arm. More particularly, the rotary actuator 124 is of conventional manufacture and design and includes a hydraulic cylinder with exposed gear and rack. Such is available from the Flo-Tork Company of Orrville, Ohio. This is an enclosed unit which is mounted on the back as seen in FIGS. 6 and 7 and the key 123*a* secures the gear 123 to the torque tube 122.

Figure 8:
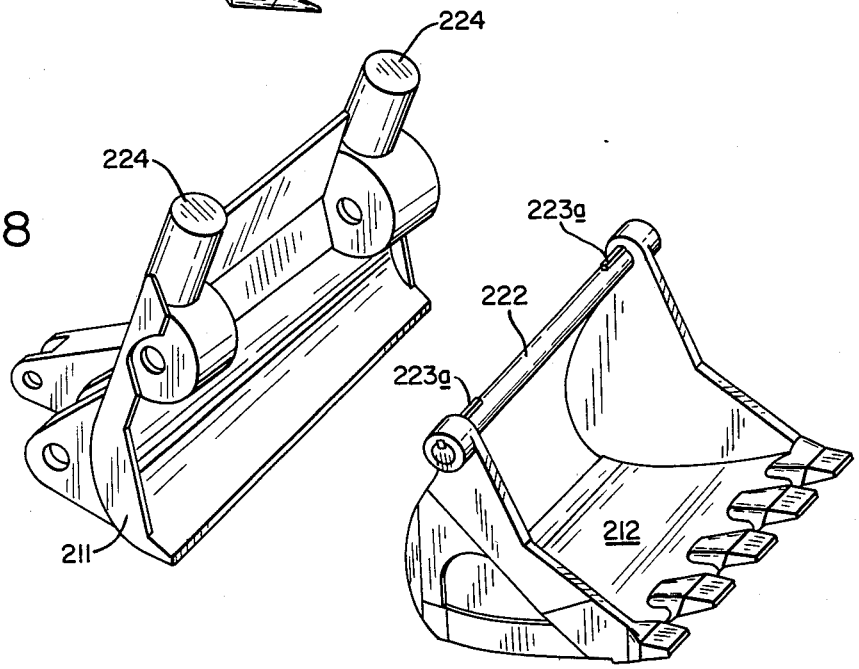
FIG. 8 is an exploded perspective view of a shovel bucket employing a pair of rotary actuators according to the invention.

Reference is now made to FIG. 8 wherein yet another embodiment of the invention is depicted and which differs essentially from the showing in FIGS. 6 and 7 in having a pair of rotary actuators 224 but again mounted on the bucket back section 211. These are spaced apart and are located adjacent the end of the torque tube 222. It will be noted that the torque tube 222 is equipped with a pair of keys 223*a* which are employed to couple the torque tube 222 to the gears (not shown) of the two rotary actuators 224. An additional advantage accrues from this form of the invention because here the rotary actuators themselves provide the supports for bushings for the torque tube and hence the bucket front section 212.

While in the foregoing specification a detailed description of an embodiment of the invention has been set down for the purpose of illustration, many variations in the details herein given may be made by those skilled in the art without departing from the spirit and scope of the invention.

We claim:

1. An excavating shovel comprising a back section and a front section pivotally related thereto, said front section including an outwardly-curved bottom wall terminating at a forward earth-engaging edge and side walls upstanding from said bottom wall, a torque tube extending between and rigidly connected to upper portions of said side walls, said torque tube being equipped with radially-extending moment arm means, said back section including a back wall having a slight outward curvature to cooperate with said front section bottom wall in developing roll-over of excavated earth and narrow forwardly-projecting side walls to cooperate with said forward section side walls in presenting a closed shovel during excavation, said back wall being equipped interiorly with bushing means, said torque tube being rotatably supported in said bushing means, and actuator means for pivoting said front section mounted on said back wall and coupled to said arm means, said back wall being equipped with window means aligned with said arm means projecting through said back wall to the exterior thereof, said actuator means being mounted on said back wall exteriorly thereof.

2. An excavating shovel comprising a back section and a front section pivotally related thereto, said front section including an outwardly-curved bottom wall terminating at a forward earth-engaging edge and side walls upstanding from said bottom wall, a torque tube extending between and rigidly connected to upper portions of said side walls, said torque tube being equipped with radially-extending arms means, said back section including a back wall having a slight outward curvature to cooperate with said front section bottom wall in developing roll-over of excavated earth and narrow forwardly-projecting side walls to cooperate with said forward section side walls in presenting a closed shovel during excavation, said back wall being equipped interiorly with bushing means, said torque tube being rotatably supported in said bushing means, said back wall being equipped with window means aligned with said arm means with said arm means projecting through said back wall to the exterior thereof, and actuator means for pivoting said front section mounted on said back wall exteriorly thereof and coupled to said arm means, said actuator means including a pair of cylinder and piston rod units spaced axially along said torque tube.

3. The shovel of claim 1 in which said back section includes a bracket for connection to a hydraulic excavator stick, said actuator means also being connected to said bracket.

4. An excavating shovel comprising a back section and a front section pivotally related thereto, said front section including an outwardly-curved bottom wall terminating at a forward earth-engaging edge and side walls upstanding from said bottom wall, a torque tube extending between and rigidly connected to upper portions of said side walls, said torque tube being equipped with radially-extending arms means, said back section including a back wall having a slight outward curvature to cooperate with said front section bottom wall in developing roll-over of excavated earth and narrow forwardly-projecting side walls to cooperate with said forward section side walls in presenting a closed shovel during excavation, said back wall being equipped interiorly with a plurality of bushings, said torque tube being rotatably supported in said bushings, said back wall being equipped with a window aligned with each of said arms with said arm projecting through said back wall to the exterior thereof, and a cylinder and piston rod unit for each arm for pivoting said front section and mounted on said back wall exteriorly thereof and coupled to one of said arms.

5. The shovel of claim 4 in which said back section is equipped with a bracket aligned with each window, a cylinder and piston rod unit connected to each bracket.

6. The shovel of claim 5 in which a hydraulic excavator stick is connected to each bracket.

7. The shovel of claim 6 in which a hydraulic excavator stick cylinder and piston rod unit is interconnected with said rear section between said hydraulic excavator stick brackets.

8. An excavating shovel bucket comprising a back section and a front section pivotally related thereto, said front section including an outwardly-curved bottom wall terminating at a forward earth-engaging edge and side walls upstanding from said botton wall, a torque tube extending between and rigidly connected to upper portions of said side walls, said torque tube being equipped with radially-extending arm means, said back section including a back wall having a slight outward curvature to cooperate with said front section bottom wall in developing roll-over of excavated earth and narrow forwardly-projecting side walls to cooperate with said forward section side walls in presenting a closed shovel during excavation, said back wall being equipped interiorly with bushing means, said torque tube being rotatably supported in said bushing means, said back wall being equipped with window means aligned with said arm means with said arm means projecting through said back wall to the exterior thereof, bracket means secured to the exterior of said back section and cylinder and piston rod means interconnected between said bracket means and arm means for pivoting said sections relative to each other to dump a load from said bucket.

* * * * *